US008120272B2

(12) United States Patent
Imam et al.

(10) Patent No.: US 8,120,272 B2
(45) Date of Patent: Feb. 21, 2012

(54) AC DELAY ANGLE CONTROL FOR ENERGIZING A LAMP

(75) Inventors: Afroz M. Imam, Peabody, MA (US); Sivakumar Thangavelu, Billerica, MA (US); Mustansir Kheraluwala, Lake Zurich, IL (US)

(73) Assignee: Osram Sylvania Inc., Danvers, MA (US)

( * ) Notice: Subject to any disclaimer, the term of this patent is extended or adjusted under 35 U.S.C. 154(b) by 792 days.

(21) Appl. No.: 12/242,854

(22) Filed: Sep. 30, 2008

(65) Prior Publication Data

US 2010/0079077 A1 Apr. 1, 2010

(51) Int. Cl.
*H05B 41/16* (2006.01)

(52) U.S. Cl. ..... 315/291; 315/224; 315/247; 315/307

(58) Field of Classification Search ..... 315/291, 315/224, 225, 247, 307–311
See application file for complete search history.

(56) References Cited

U.S. PATENT DOCUMENTS

| | | | | |
|---|---|---|---|---|
| 3,538,427 | A | 11/1970 | Oltendorf | |
| 7,852,017 | B1 * | 12/2010 | Melanson | 315/291 |
| 2005/0110437 | A1 | 5/2005 | Ballenger et al. | |

FOREIGN PATENT DOCUMENTS

WO 96/21894 A1 7/1996

OTHER PUBLICATIONS

European Search Report and Search Opinion for EP 09 012 258.1-2206, European Patent Office, mailed Feb. 11, 2010.

* cited by examiner

*Primary Examiner* — Tuyet Thi Vo
(74) *Attorney, Agent, or Firm* — Shaun P. Montana

(57) ABSTRACT

A control circuit for a lamp. The control circuit is used in conjunction with an alternating current (AC) variable voltage power source to energize the lamp. The control circuit includes a voltage sensing component for sensing the voltage of an voltage input signal from the power source for energizing the lamp. The control circuit includes a controller configured to estimate a delay angle as a linear function of the sensed voltage. The control circuit includes an AC converter for modifying the voltage input signal according to the estimated delay angle to generate an AC voltage output signal having a constant root mean square voltage for energizing the lamp.

25 Claims, 12 Drawing Sheets

AC DELAY ANGLE CONTROL FOR ENERGIZING A LAMP

FIELD OF THE INVENTION

The present invention generally relates to a control circuit that provides a particular power to a load, and more specifically to a control circuit for a lamp that uses an alternating current (AC) input voltage to obtain a voltage suitable for lamp operation.

BACKGROUND OF THE INVENTION

High-intensity discharge (HID) lamps such as mercury vapor, metal halide, high-pressure sodium, low-pressure sodium lamps types are generally time consuming to ignite re-ignite. Typically, an ignition period of about twenty minutes may be needed in order for the lamp to sufficiently cool prior to attempting re-ignition.

Re-ignition may occur frequently, especially when the lamps are used with an unreliable power source. Generally, HID lamps will extinguish when power to the lamp is interrupted. Power interruptions of even a very short duration, e.g., tens of milliseconds, will often extinguish the lamp.

Since HID lamps are not illuminated during the lengthy ignition periods, they are often used in lamp system with an auxiliary lamp. The auxiliary lamp is responsive to the unlit HID lamp and accordingly provides light during the ignition period or whenever the HID lamp otherwise unavailable or unlit These lamp systems generally include an alternating current (AC) power source which may have a variable amplitude. The auxiliary lamp, such as an incandescent lamp, generally requires a constant root mean squared (rms) voltage in order to operate properly. Accordingly, the lamp systems must include a control circuit for providing a constant root mean squared (rms) voltage.

SUMMARY OF THE INVENTION

Embodiments of the invention control an output voltage that is generated from a voltage input signal having a variable amplitude and/or frequency. In one embodiment, the invention provides a constant root mean squared (rms) voltage output for energizing a lamp from a voltage input signal having a variable amplitude and/or frequency.

In particular, embodiments of the invention estimate a delay angle as a linear function of a sensed input voltage. The delay angle is estimated so that when it is applied to the input voltage signal, a voltage output signal having a constant rms voltage is generated.

In one embodiment, the delay angle is estimated by a controller in a lamp system. By using a linear function to estimate the delay angle, the present invention provides an efficient method and device for controlling the voltage output signal.

Other objects and features will be in part apparent and in part pointed out hereinafter.

BRIEF DESCRIPTION OF THE DRAWINGS

Corresponding reference characters indicate corresponding parts throughout the drawings.

DESCRIPTION

Embodiments of the invention generally relate to a control circuit used with an input power source for energizing a load. In particular, embodiments of the invention determine a delay angle that is used to convert an alternating current (AC) input power signal from the input power source to an output power signal suitable for operating the load.

In an embodiment of the invention, the control circuit is used in a lamp system to generate a voltage signal suitable for energizing a lamp. For example, the control circuit may be used in a lamp system to account for variations, such as amplitude and/or frequency variations, in an input voltage signal supplied by the power source so that a constant voltage signal is provided to the lamp in the system. As generally known, some lamps, including incandescent lamps, operate most efficiently from a constant (broadly, substantially constant) voltage. Accordingly, the control circuit allows such lamps to efficiently operate in a lamp system that has a variable input voltage power source.

Figure 1:
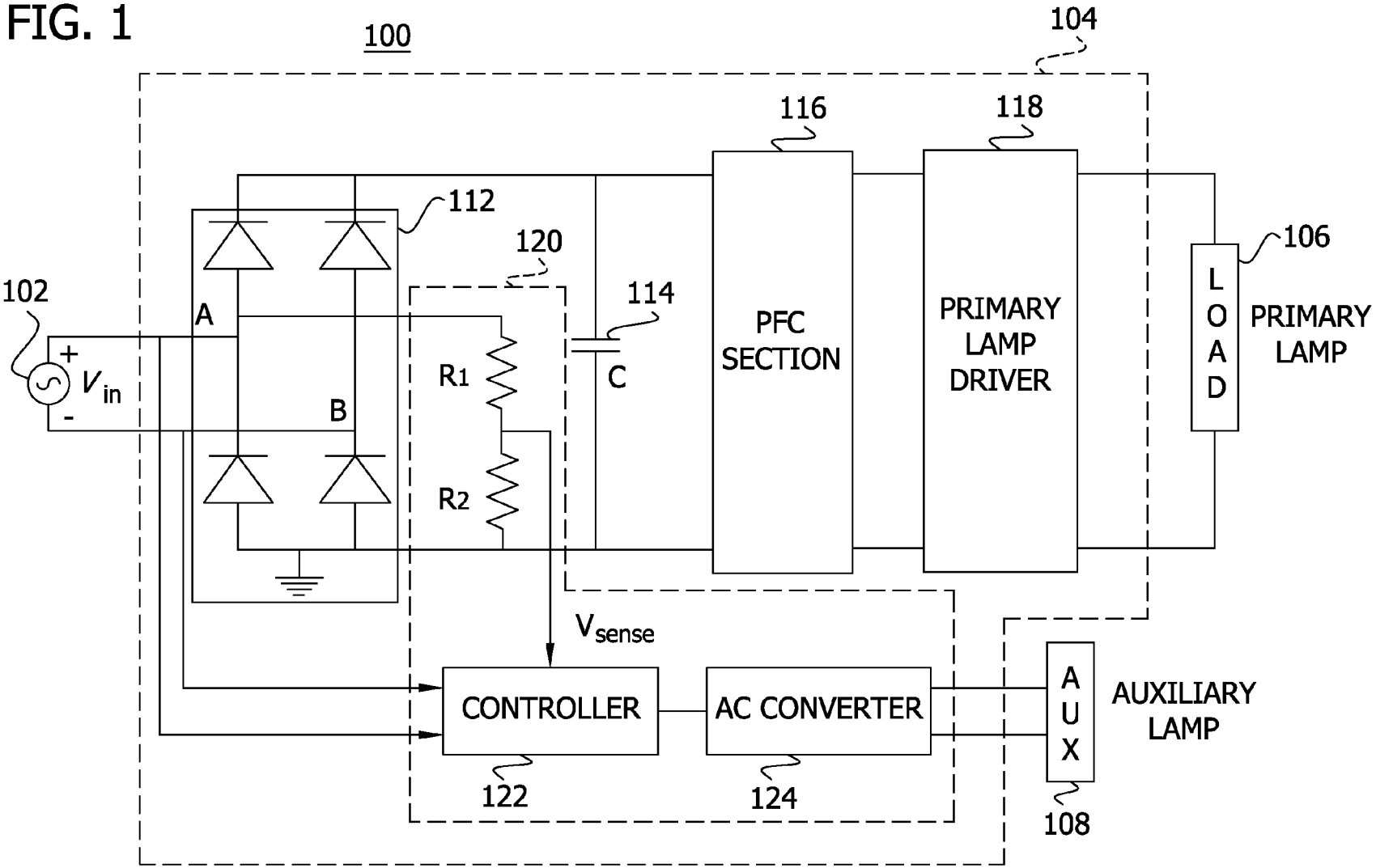
FIGS. 1 and 2 are block diagrams illustrating lamp systems that have a control circuit according to an embodiment of the invention.

FIG. 1 illustrates an exemplary lamp system 100 according to an embodiment of the invention. The lamp system 100 includes an alternating current (AC) power source 102, a lamp energizing circuit 104, a primary lamp 106, and an auxiliary lamp 108. The illustrated lamp system 100 is configured for energizing the primary lamp 106 and the auxiliary lamp 108 wherein the primary lamp 106 includes one or more high-intensity discharge (HID) lamps (e.g., mercury vapor, metal halide, high-pressure sodium, low-pressure sodium lamps) and the auxiliary lamp 108 includes one or more incandescent lamps. The lamp system 100 may be configured for energizing other types of lamps, without departing from the scope of the invention.

The lamp energizing circuit 104 is adapted for receiving a variable voltage input signal from the power source 102 and generating a voltage output signal based on the received voltage input signal for energizing the primary lamp 106 and/or the auxiliary lamp 108. There are numerous causes for variations in the input voltage. For example, in one embodiment, the power source 102 includes a first voltage source (e.g., 120 volts AC) and a second voltage source (e.g., 277 volts AC). Significant variations in the amplitude of the input voltage (e.g., amplitude may vary from between about 187 Volts to about 305 Volts) occur when the power source 102 changes between the first voltage source and the second voltage source. Additionally or alternatively, the first and second voltage sources may have different frequencies and thus significant variations in the frequency occur when the power source 102 changes between the first and second voltage sources. Additionally or alternatively, the voltage input signal may include smaller voltage variations due to signal distortion (e.g., harmonics/noise injected into the voltage input signal by other electrical devices).

The lamp energizing circuit 104 includes primary lamp energizing components 104 (e.g., rectifier 112, smoothing capacitor 114, power factor control circuit 116, primary lamp driver 118) for generating a voltage output signal based on the received variable voltage input signal for selectively energizing the primary lamp 106. The primary lamp energizing components 104 discussed herein are for energizing an HID lamp. For example, the primary lamp energizing components 104 may be included in an electronic ballast for energizing the HID primary lamp 106. Additional or alternative components may be used for energizing other types of lamps without departing from the scope of the invention. The rectifier 112 (e.g., full wave rectifier) converts the AC voltage input signal to a direct current (DC) voltage signal. The smoothing capacitor 114 filters the rectified voltage input signal in order to minimize any AC ripple voltage present in the rectified voltage input signal. The power factor control circuit 116, such as a boost converter, converts the filtered voltage input signal to a high DC voltage (e.g., 460 volts DC) signal. The primary lamp driver 118 (broadly, primary lamp driver and ignition circuit) includes an inverter circuit, such as a resonant converter, which converts the high DC voltage signal into a suitable AC voltage output signal for energizing the primary lamp 106.

The lamp energizing circuit 104 includes a control circuit 120 for generating a substantially constant root mean square (rms) voltage output signal based on the received variable voltage input signal for selectively energizing the auxiliary lamp 108. Voltage output $(V_o)_{rms}$ is related to voltage input $(V_{in})_{rms}$ as follows $$(v_o)_{rms} = \frac{(V_{in})_{rms}}{\sqrt{\pi}}\sqrt{\pi - \theta + \sin\theta\cos\theta} \quad \text{(Equation 1)}$$

wherein θ represents a delay angle that is applied to the voltage input $(V_{in})_{rms}$. Additional details regarding the derivation of Equation 1 are given in Appendix A.

The control circuit 120 includes a voltage sensing component for sensing the voltage of the voltage input signal. According to the illustrated embodiment, the voltage sensing component comprises a voltage divider having two resistors (R1, R2) for sensing the voltage of the half rectified voltage input signal.

The control circuit 120 includes a controller 122 (e.g., microcontroller, microprocessor) for receiving, via a controller input channel, the sensed voltage from the voltage sensing component. According to the illustrated embodiment, the sensed voltage $V_{sense}$ is a voltage value of the input voltage signal at point A ($V_A$) which has been stepped down by the voltage divider R1, R2. Specifically, the sensed voltage $V_{sense}$ is related to the input voltage signal $V_A$ as follows $$V_{sense} = kv_A \quad \text{(Equation 2)}$$

Where k is given by $$k = \frac{R_2}{R_1 + R_2} \quad \text{(Equation 3)}$$

In one embodiment, the value of k is selected such that $V_{sense}$ never exceeds a maximum voltage limit of the controller input channel.

The controller 122 is configured, based on the relationship set forth in Equation 1, to calculate a delay angle as a function of the sensed voltage $V_{sense}$. More particularly, the controller 122 is configured to calculate a delay angle, which when applied to the voltage input signal, will generate an output signal having a particular rms voltage value $(V_o)_{rms}$. The particular output rms voltage value $(V_o)_{rms}$ is pre-selected based on the operating requirements of the auxiliary lamp 108. For example, in the illustrated lamp system 100, the particular rms voltage value $(V_o)_{rms}$ may be 120 Volts, which is recommended for efficiently operating a standard incandescent lamp.

The control circuit 120 includes an AC converter 124 for modifying the voltage input signal according to the calculated delay angle to generate a constant rms AC voltage output signal. The generated AC voltage output signal is applied/provided to the auxiliary lamp 108 in order to energize the lamp 108.

Figure 2:
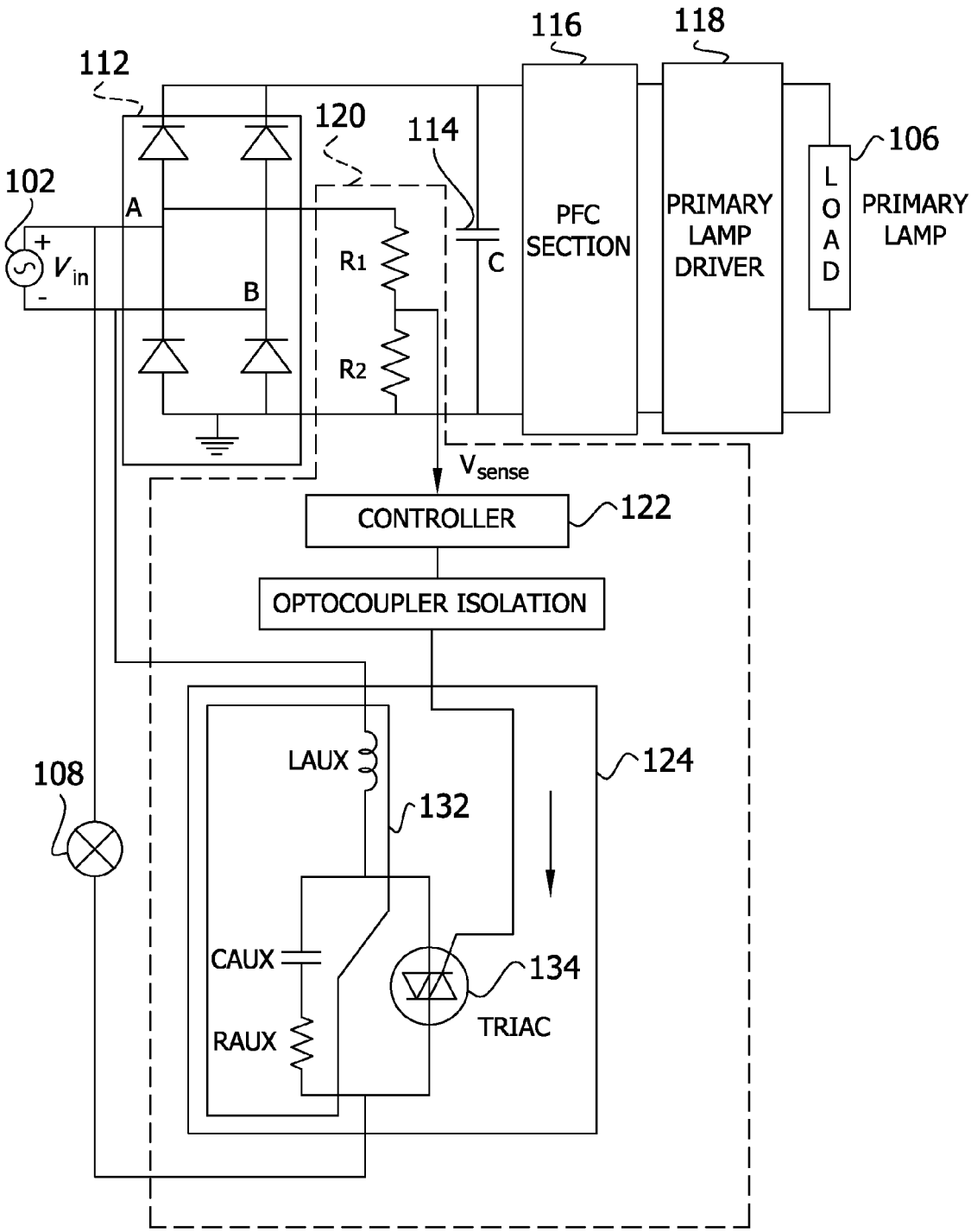

Referring to FIG. 2, in one embodiment, the AC converter 124 includes an AC chopper circuit 124 electrically connected to the power source 102 for receiving the voltage input signal and to the controller 122 via a controller output channel for receiving a control signal. The AC chopper circuit 124 generates the voltage output signal as a function of the voltage input signal and the control signal. The AC chopper circuit 124 is electrically connected to the auxiliary lamp 108 for providing the voltage output signal to the auxiliary lamp 108.

For example, the AC chopper circuit 124 may include an AC bidirectional switch (e.g., triac 134) electrically connected between the power source 102 and the auxiliary lamp 108 that can be selectively operated in a conducting state or a non-conducting state. When the switch 134 is operated in the conducting state it conducts the voltage input signal and when the switch 134 is operated in the non-conducting state it does not conduct the voltage input signal. The triac 134 is operated in the non-conducting state during a delay period defined by the delay angle θ. The triac 134 is otherwise operated in the conducting state. As illustrated in FIG. 2, the AC chopper circuit 124 may also include a snubber circuit 132 for suppressing voltage transients in order to protect the switch 134.

Figure 3A:
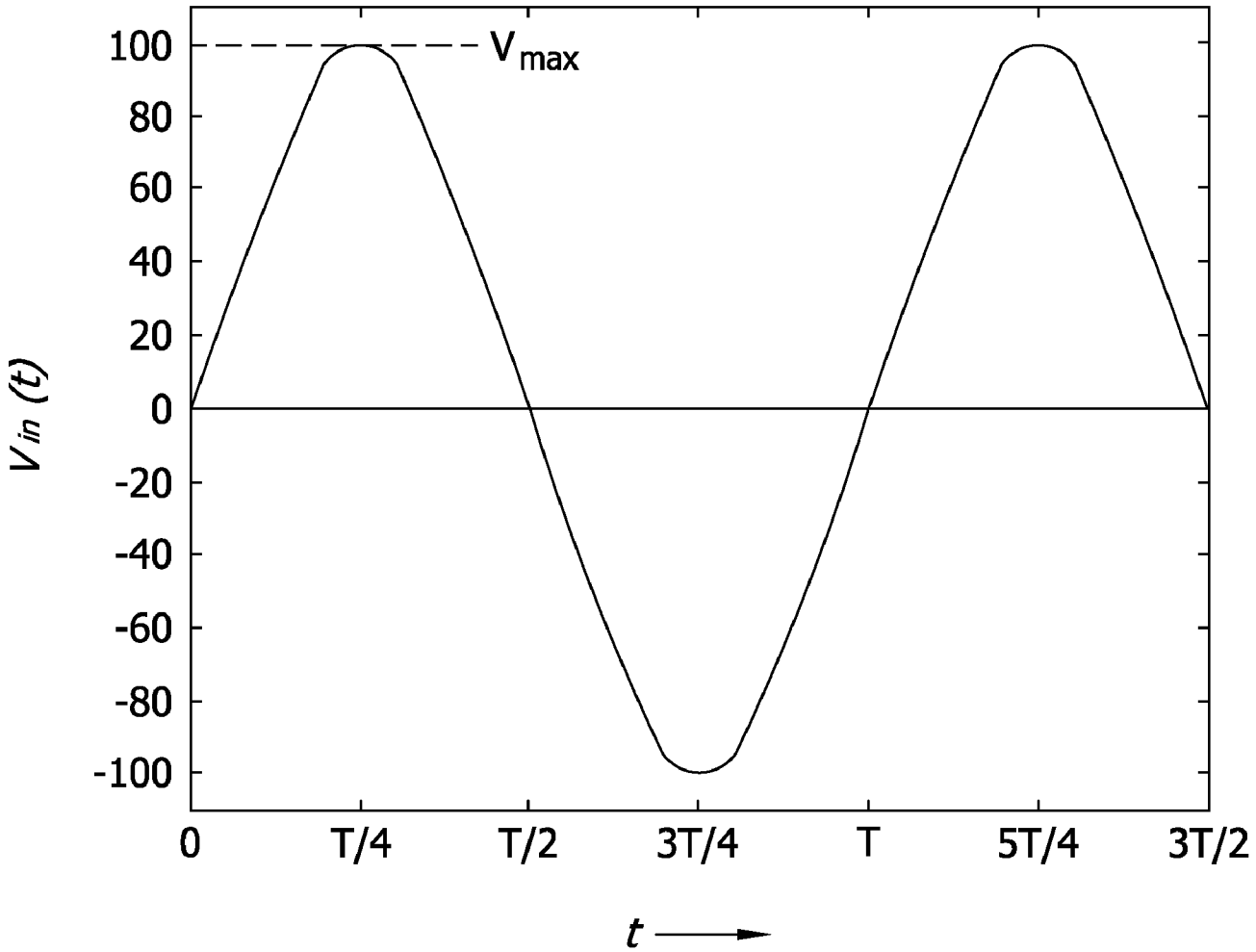
FIG. 3A is graph illustrating an exemplary voltage input signal according to an embodiment of the invention.
Figure 3B:
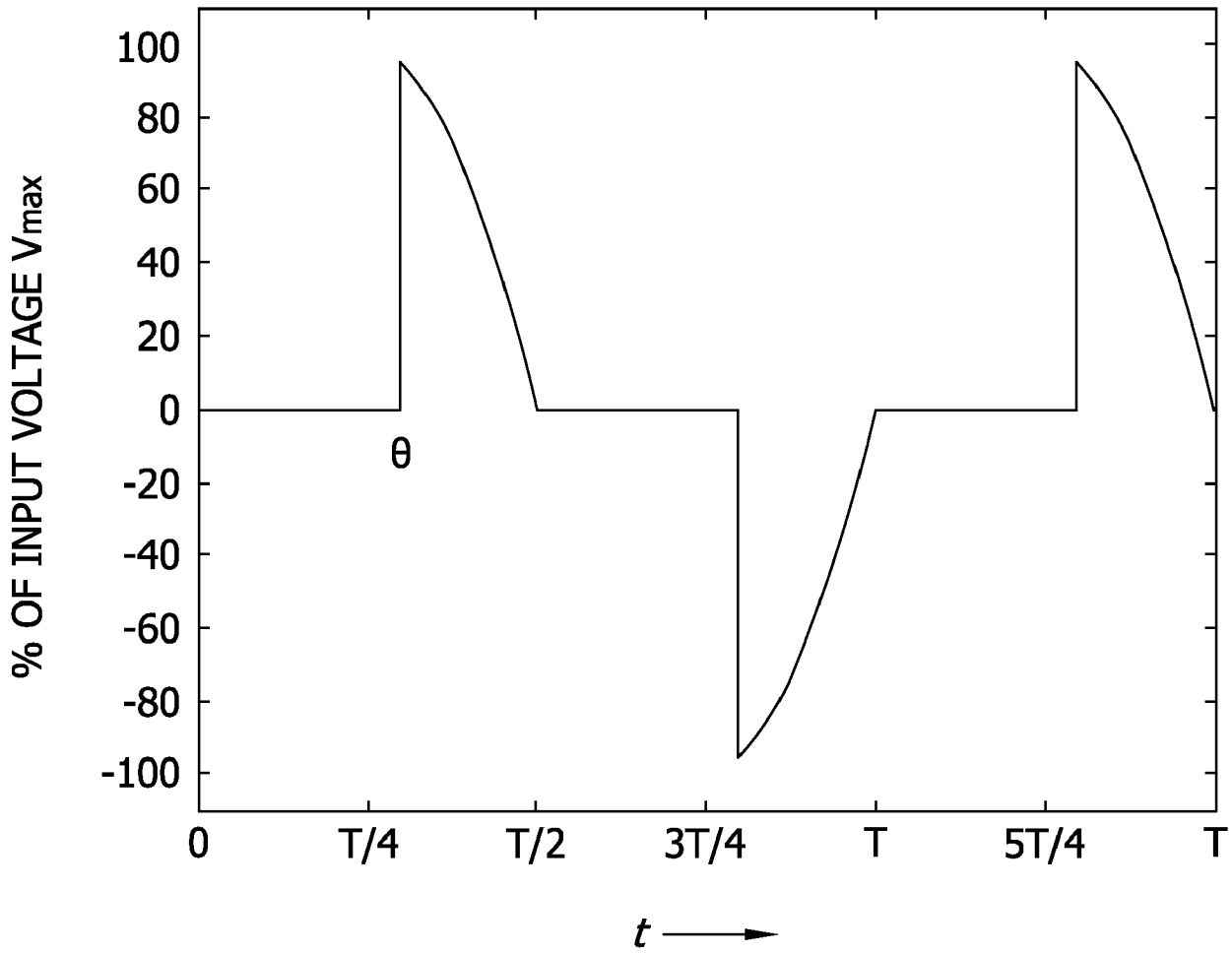
FIG. 3B is a graph illustrating an exemplary voltage output signal according to an embodiment of the invention.

FIG. 3A is a graph representing an exemplary voltage input signal as a function of time according to one embodiment of the invention. Each cycle of the voltage input signal includes a positive half cycle (portion of cycle during which voltage values are greater than zero) and a negative half cycle (portion of cycle during which voltage values are less than zero). As shown by the graph, the positive half cycle and the negative half cycle each include a portion in which the voltage values are increasing and a portion in which the voltage values are decreasing. FIG. 3B is a graph representing as a function of time an output voltage signal generated by blocking the voltage input signal by a delay angle θ. In particular, the voltage values of the voltage input signal are converted to zero during a period of time defined by the delay angle θ. As shown by the graphs, a delay angle θ is applied to the voltage input signal during the positive half cycles and the negative half cycles.

Referring generally to FIGS. 3A and 3B, in one embodiment, the delay angle may be chosen so that the voltage output signal has a lower rms voltage than that of the input signal. In particular, when the delay angle θ defines a delay period which includes a maximum voltage value $V_{max}$ of the voltage input signal, the voltage output signal will have a lower rms voltage than the voltage input signal.

As indicated by Equation 1, the relationship between the voltage input $(V_{in})_{rms}$ and the voltage output $(V_o)_{rms}$ is non-linear. In order to simplify computations performed by the controller 122 for determining the delay angle, the controller 122 may be configured to estimate the delay angle based on an approximate linear relationship between the amplitude of the voltage input signal and the delay angle for a pre-selected output rms voltage value $(V_o)_{rms}$. Thus, by simplifying the computations required by the controller 122, the present invention provides an efficient an accurate method of determining a delay angle for a variable voltage input signal.

Figure 4:
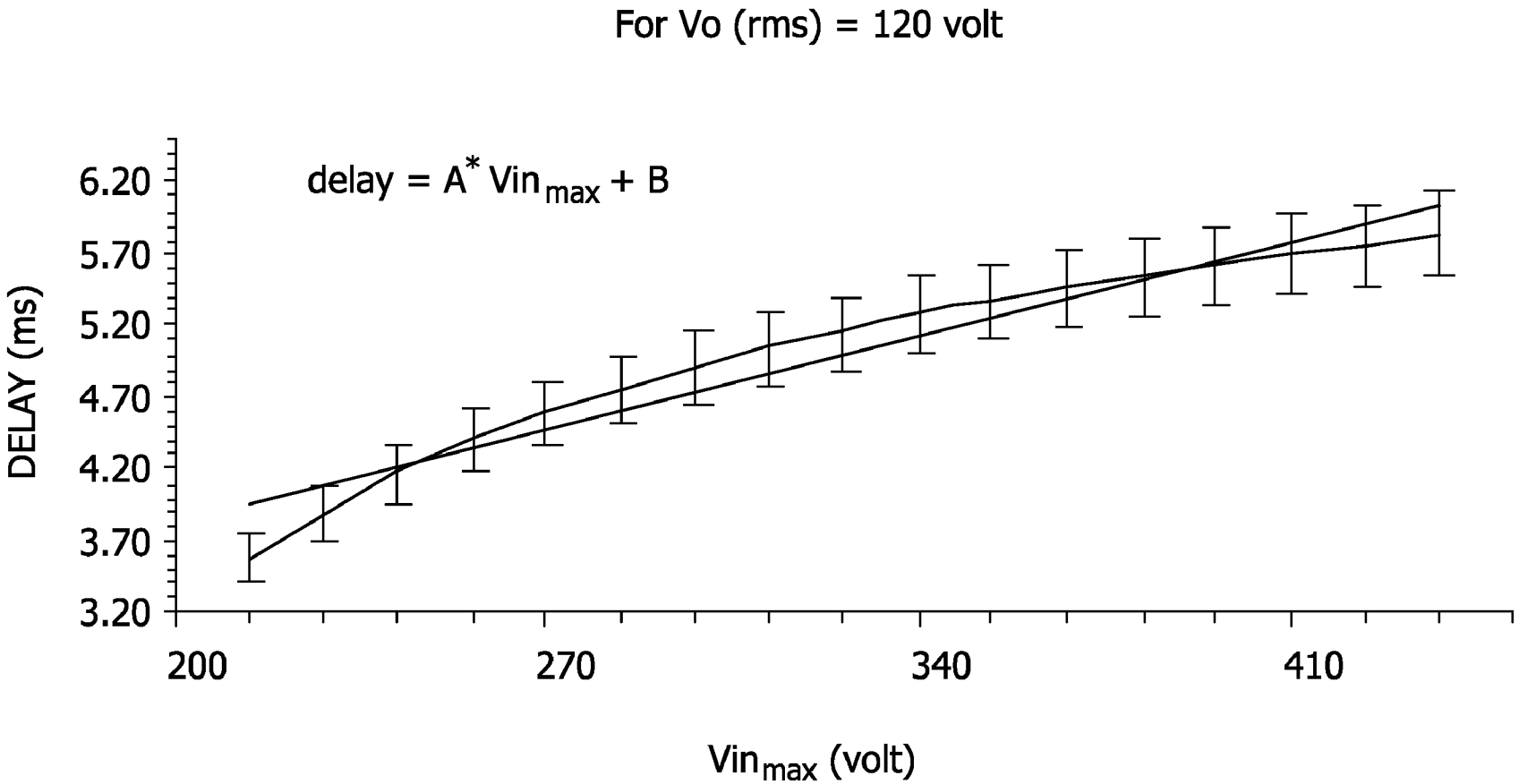
FIG. 4 is a graph illustrating an actual and approximate relationship between maximum voltage of an input signal and delay angle for generating a 120 Volt rms output signal according to an embodiment of the invention.

FIG. 4 is a graph illustrating the actual (non-linear) relationship between a maximum value of the voltage input signal $V_{max}$ and the delay angle in order to generate a constant 120 V rms voltage output signal. The graph also illustrates a linear curve-fitting of the actual relationship plot. As shown by the graph, the linear curve fitting provides a relatively accurate estimate of the delay angle for each of the maximum voltage input values.

In one embodiment, the controller 122 is configured to identify a maximum voltage value for an AC cycle of the voltage input signal based on the voltage sensed by the voltage sensing component and to determine a delay angle for the AC cycle as a linear function of the identified maximum voltage value $V_{max}$. More particularly, the controller 122 is configured to determine the delay angle used to modify the input signal, having a particular frequency f, according to the following linear formula:

$$\text{Delay}=A(f)\times V\text{in}_{max}+B(f) \qquad \text{(Equation 4)}$$

Wherein A and B are constants pre-defined for generating an output signal having the pre-selected rms voltage $(V_o)_{rms}$ from the input signal having the particular frequency f.

The controller 122 is configured to determine a delay angle for each positive half cycle and for each negative half cycle. In one embodiment, the controller 122 determines the delay angle for each positive half cycle using the linear formula of Equation 4 and determines the delay angle for each negative half cycle based on the determined delay angle for the corresponding positive half cycle. For example, the controller 122 may determine the delay angle for a negative half cycle included in a particular cycle by computing the sum of the determined delay angle for positive half cycle included in the particular cycle and a time period (T/2) corresponding to negative half of the particular cycle.

Figure 5:
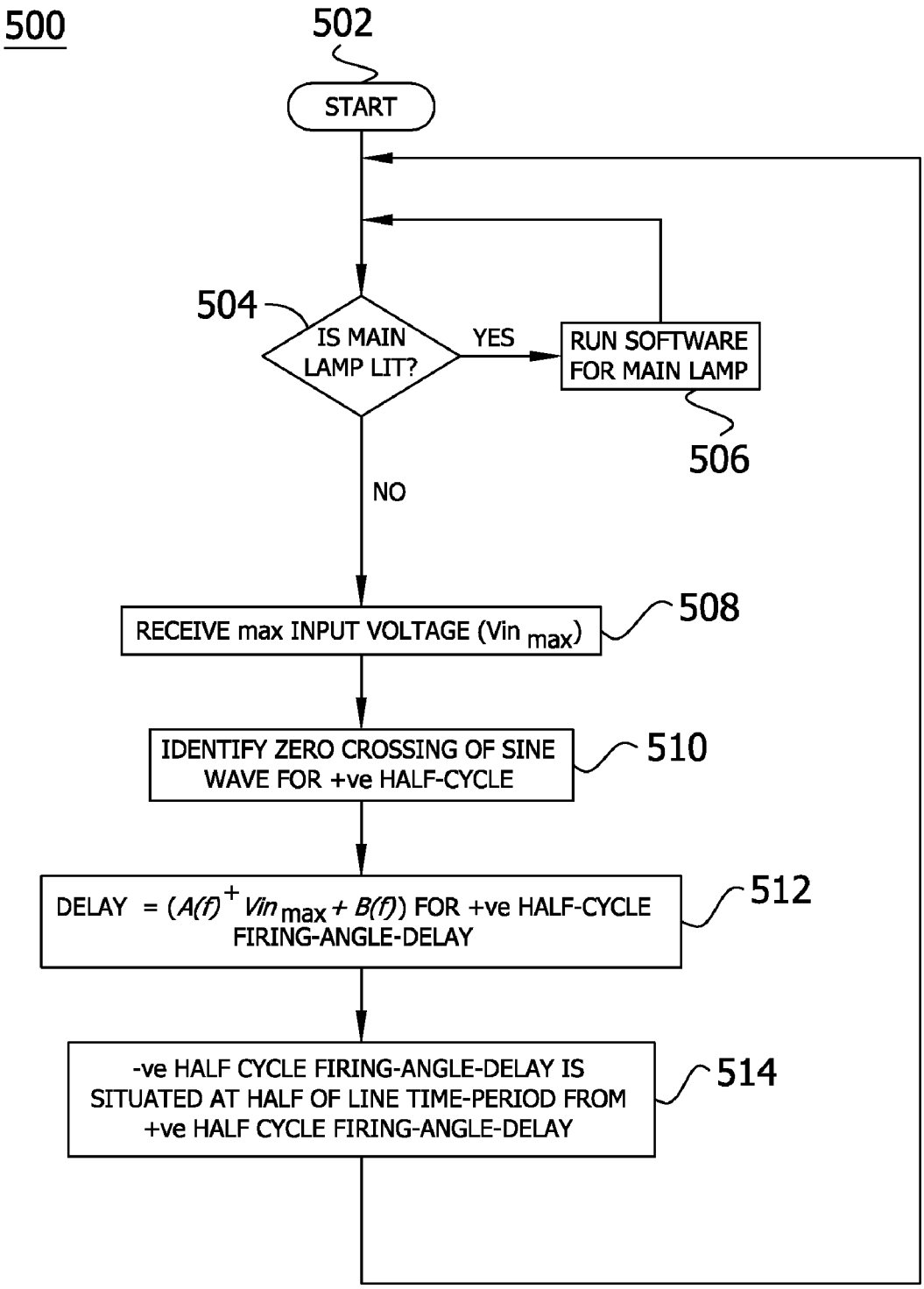
FIG. 5 is a flow diagram of a method for determining a delay angle according to an embodiment of the invention.

FIG. 5 is a flow chart illustrating a method 500 implemented by the controller 122 of a control circuit 120 used in a lamp system 100 to determine a delay angle for an auxiliary lamp 108 in the lamp system 100 according to an embodiment of the invention. In this lamp system 100, the controller 122 is also used to control the operation of the primary lamp 106. For example, the controller 122 is electrically connected to one or more of the primary lamp energizing components 104 for controlling the components 104.

Once the method is initiated at 502, the method at 504 determines whether the primary lamp 106 (i.e., main lamp) is lit (e.g, illuminated). If the primary lamp 106 is determined to be lit, the method at 506 initiates a set of instructions (e.g., software program) for controlling the operation of the primary lamp 106. If the primary lamp 106 is determined not to be lit, the method at 508 identifies a maximum voltage value $V_{max}$ for a particular cycle of the voltage input signal. For example, the controller 122 may receive a plurality of voltage values sensed by the voltage sensing component at a pre-defined/particular time interval during the cycle. The controller 122 may compare the plurality of received voltage values in order to identify the maximum voltage value (e.g., largest voltage values of the received voltage values).

The method at 510 includes identifying a zero crossing of the input signal for triggering the delay angle for the positive half cycle of the particular cycle. For example, the controller 122 may receive voltage values $V_{sense}$ sensed by the voltage sensing component and identify the zero crossing based on the received voltage values $V_{sense}$. The method at 512 determines the delay angle for the positive half cycle of the particular cycle using Equation 4 as discussed above.

The method at 514 determines the delay angle for the negative half cycle based on the determined delay angle for the positive half cycle. For example, the controller 122 may transmit a control signal to the AC converter 124 that causes the AC converter 124 to fire the delay angle during the negative half cycle after a time period corresponding to half of the particular cycle has elapsed since the firing of the delay angle for the positive half cycle. After the method at 514 determines the delay angle for the negative half cycle, the method returns to 502 and repeats the steps 502-514.

Figure 6:
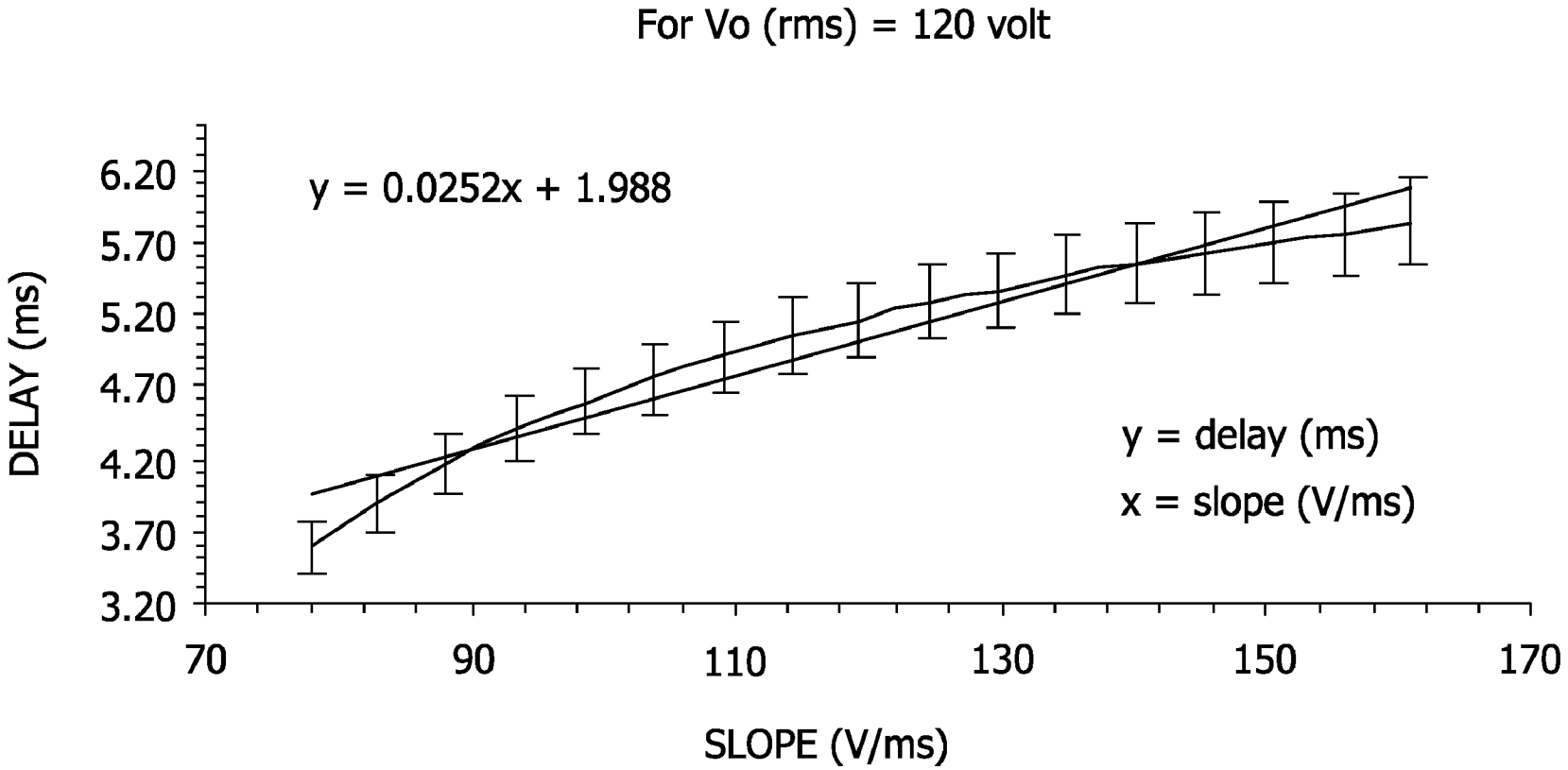
FIG. 6 is a graph illustrating an actual and approximate relationship between slope of a linear region of an input signal and delay angle for generating a 120 Volt rms output signal according to an embodiment of the invention.
Figure 7:
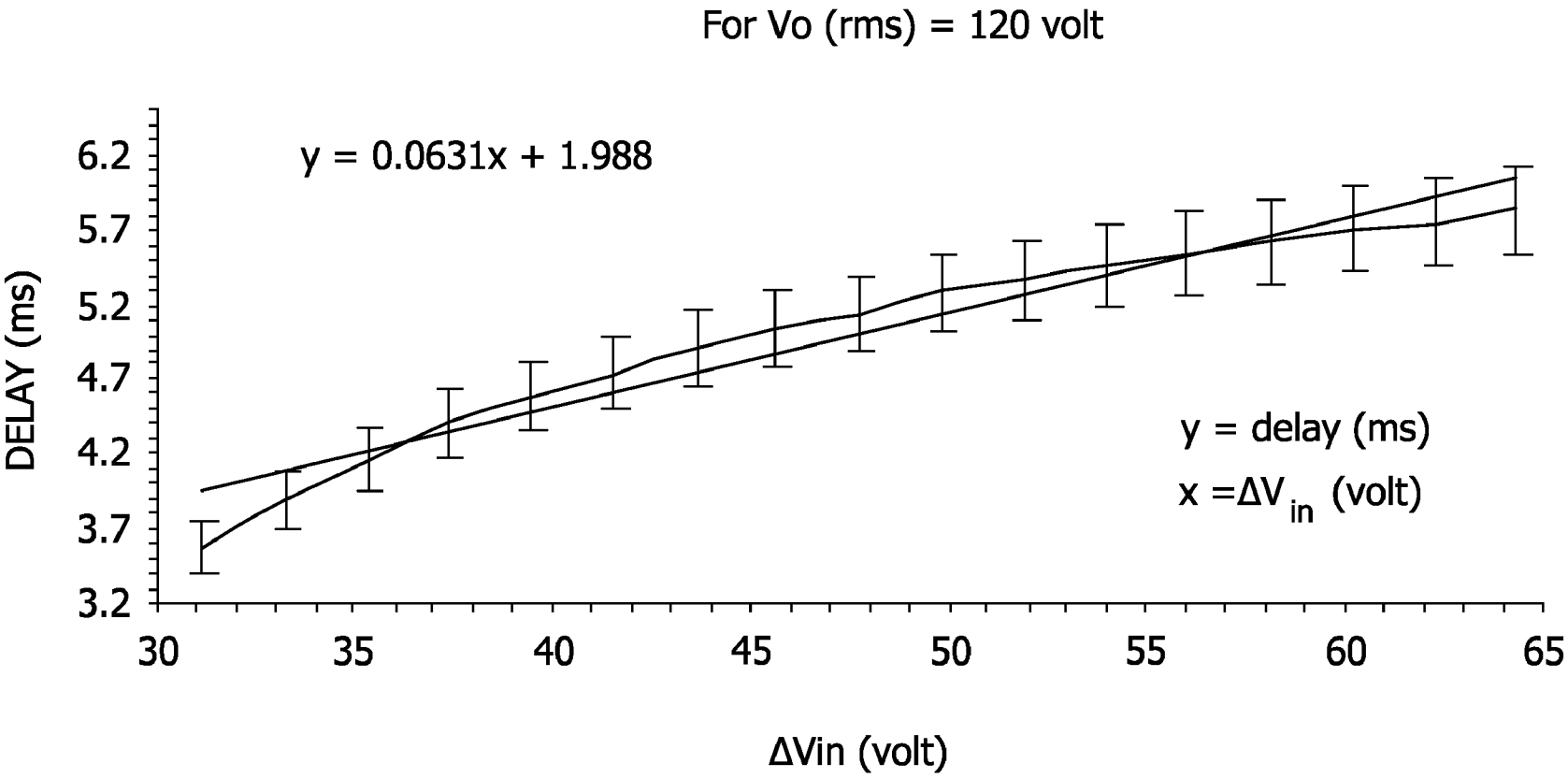
FIG. 7 is a graph illustrating an actual and approximate relationship between voltage difference in a linear region of an input signal and delay angle for generating a 120 Volt rms output signal according to an embodiment of the invention.

Another embodiment of the invention contemplates that the amplitude of the voltage input signal for a particular cycle is proportional to the slope of voltage input signal near the zero-crossing (i.e., in the linear region) of the particular cycle. FIG. 6 is a graph illustrating the actual (non-linear) relationship between slope of the linear region of the voltage input signal and a corresponding delay angle for generating a 120 V rms voltage output signal. The graph also illustrates a linear curve-fitting of the actual relationship plot. As shown by the graph, the linear curve fitting provides a relatively accurate estimate of the delay angle for each of the slope values. Similarly, FIG. 7 illustrates an actual plot and a linear curve fitting plot of the relationship between voltage difference in the linear region of the voltage input signal and a corresponding delay angle for generating 120 V rms voltage output signal. As slope is directly proportional to voltage difference, a linear function may also be used to estimate a delay angle from a voltage difference in the linear region of the voltage input signal. Accordingly, in one embodiment, the controller 122 is configured to calculate voltage difference $\Delta V_{in}$ of voltage values near the zero crossing and to determine the delay angle based on the calculated voltage difference $\Delta V_{in}$.

Figure 8:
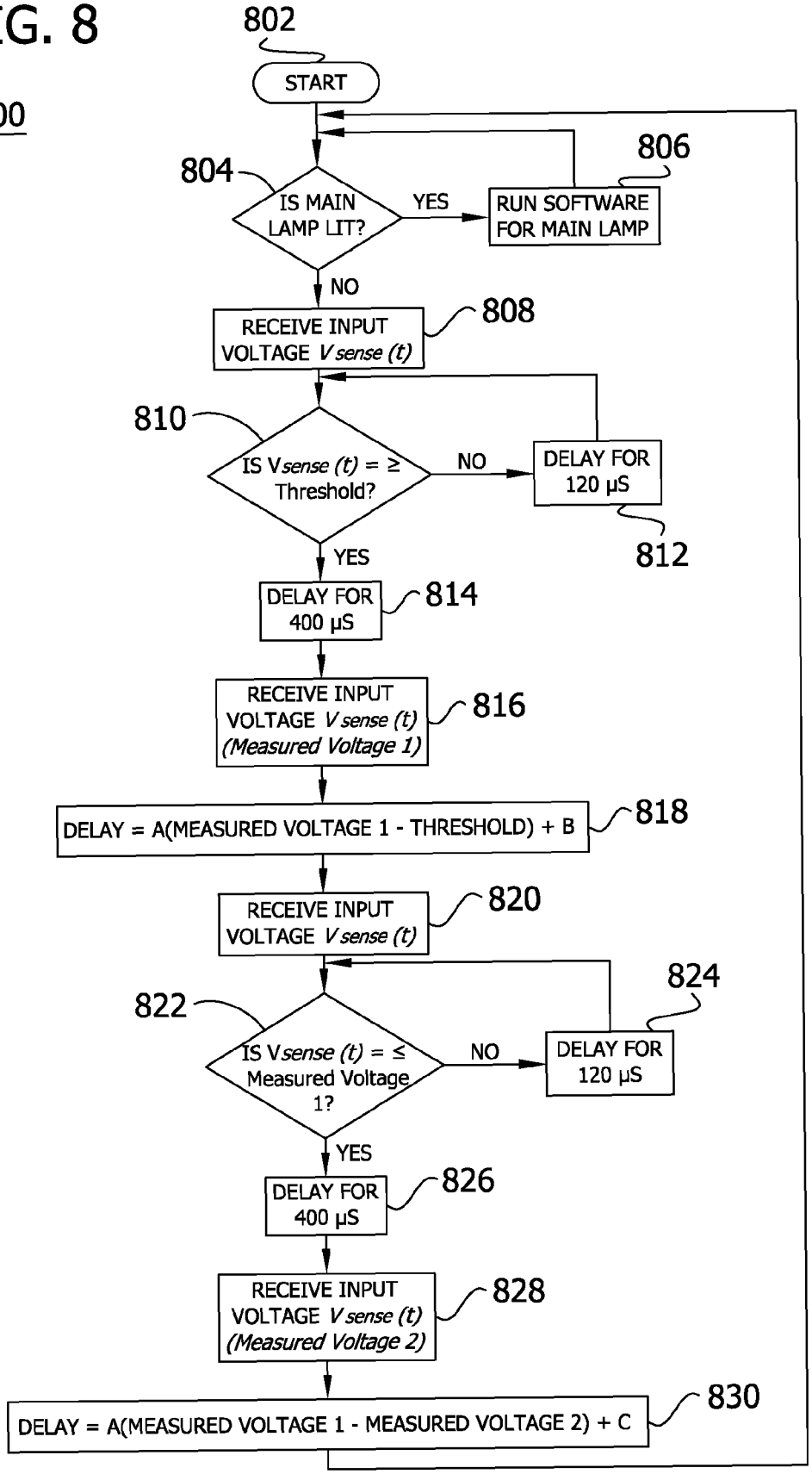
FIG. 8 is a flow diagram of a method for determining a delay angle according to an embodiment of the invention.

FIG. 8 is a flow chart illustrating an example of such a method 800 which is implemented by the controller 122 of a control circuit 120 used in a lamp system 100 to determine a delay angle for an auxiliary lamp 108 in the lamp system 100. In particular, the method includes steps 808-818 for determining a delay angle for a positive half cycle of the input signal. The method includes steps 820-830 for determining a delay angle for the negative half cycle of the input signal. In this lamp system 100, the controller 122 is also used to control the operation of the primary lamp 106. For example, the controller 122 is electrically connected to one or more of the primary lamp energizing components 104 for controlling the components 104.

Once the method is initiated at 802, the method at 804 determines whether the primary lamp 106 (i.e., main lamp) is lit (e.g, illuminated). If the primary lamp 106 is determined to be lit, the method at 806 initiates a set of instructions (e.g., software program) for controlling the operation of the primary lamp 106. If the primary lamp 106 is determined not to be lit, the method receives at 808 a voltage value measured from the voltage input signal (e.g., near the zero crossing, in the linear region). For example, the controller 122 may receive the voltage value from the voltage sensing component.

The method at 810 determines whether the received voltage value is greater than or equal to a threshold voltage value ("ThresholdVoltage"). For example, the threshold value may represent a pre-defined voltage value that is far enough from the actual zero crossing that it is unlikely to include noise which may be present at the zero crossing and close enough to be in the linear region of the input signal so that it can be used to accurately estimate the delay angle using a linear function. If the received voltage value is not greater than or equal to the threshold voltage value, the method at 812 initiates a delay period (e.g., 120 microseconds) and then at 810 considers whether another received voltage value is greater than or equal to the threshold voltage value. For example, the controller 122 may cause the voltage sensing component to sense an initial voltage value. If the controller 122 determines that the initial voltage value is not greater than or equal to the threshold voltage value, the controller 122 may cause the voltage sensing component to, after the delay period, sense a subsequent voltage value.

Steps 810 and 812 are repeated until the method determines that the received voltage value is greater than or equal to the threshold voltage value. When the method determines that the received voltage value is greater than or equal to the threshold voltage value, the controller 122 initiates another delay period (e.g., 400 microseconds). When the delay period elapses, the method at 816 receives a voltage value ("first measured voltage value", "MeasuredVoltage1") measured from the input signal.

The method at 818 determines the delay angle for the positive half cycle as a linear function of the threshold voltage value and the first measured voltage value. In particular, the method determines the delay angle for the positive half cycle according to the following linear formula:

$$\text{Delay}=A(\text{MeasuredVoltage1}-\text{Threshold Voltage})+B \qquad \text{(Equation 5)}$$

wherein A and B are constants pro-defined for generating an output signal having the pre-selected rms voltage $(V_o)_{rms}$ from the input signal having the particular frequency f.

After determining the delay angle for the positive half cycle, the method determines the delay angle for the corresponding negative half cycle. In particular, the method receives at 820 a voltage value measured from the voltage input signal (e.g., near the zero crossing, in the linear region). For example, the controller 122 may receive the voltage value from the voltage sensing component.

The method at 822 determines whether the received voltage value is less than or equal to the first measured voltage value. It is to be noted that the received voltage may be compared to a different defined voltage value without departing from the scope of the invention. If the received voltage value is not less than or equal to the first measured voltage value, the method at 824 initiates a delay period (e.g., 120 microseconds) and then at 822 considers whether another received voltage value is less than or equal to the first measured voltage value. For example, the controller 122 may cause the voltage sensing component to operate in a similar manner as discussed above in conjunction with steps 810 and 812.

Steps 822 and 824 are repeated until the method determines that the received voltage value is less than or equal to the first measured voltage value. When the method determines that the received voltage value is less than or equal to the first measured voltage value, the method initiates another delay period (e.g., 400 microseconds). When the delay period elapses, the method at 828 receives a voltage value ("second measured voltage value", "MeasuredVoltage2") measured from the input signal.

The method at 830 determines the delay angle for the negative half cycle as a linear function of the first measured voltage value and the second measured voltage value. In particular, the method determines the delay angle for the negative half cycle according to the following linear formula:

$$\text{Delay}=A(\text{MeasuredVoltage1}-\text{MeasuredVoltage2})+C \qquad \text{(Equation 6)}$$

Wherein A and C are constants pre-defined for generating an output signal having the pre-selected rms voltage $(V_o)_{rms}$ from the input signal having the particular frequency f.

After the method at 830 determines the delay angle for the negative half cycle, the method returns to 802 and repeats the steps 802-830.

Figure 9:
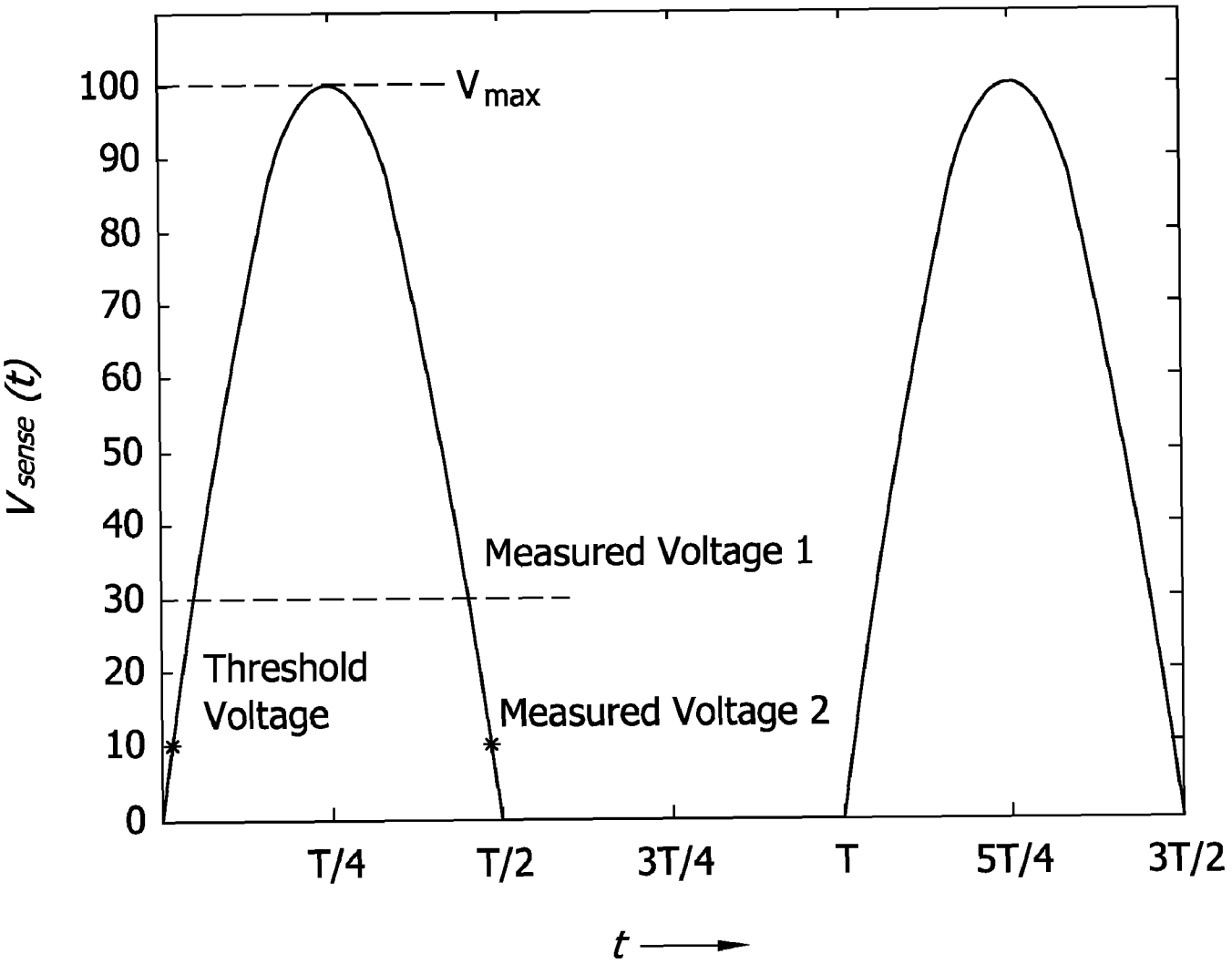
FIG. 9 is a graph illustrating an exemplary half-rectified voltage input signal according to an embodiment.

FIG. 9 is a graph of an exemplary input signal that has been rectified. The graph shows four exemplary voltage values (e.g., a first voltage value, a second voltage value, a third voltage value, and a fourth voltage value) with reference to the input signal which may be used to estimate a delay angle for the input signal. For purposes of consistency, the exemplary voltage values are labeled as they were described above with reference to method 800.

In one embodiment, the frequency of the input voltage signal is pre-determined. Accordingly, the controller 122 may be configured to determine the delay angle using a linear formula in which the constants (e.g., A, B, C) are pre-defined for the pre-determined frequency. For example, as illustrated in FIG. 4, for an input signal having a frequency of 60 Hz, the controller 122 may be configured to use the linear formula:

$$\text{Delay}=0.0631(\text{MeasuredVoltage1}-\text{ThresholdVoltage})+1.988$$

in order to generate an output signal having a constant rms voltage of about 120 Volts.

In another embodiment, the frequency of input voltage signal may be variable and the controller 122 is configured to determine the frequency of the input voltage signal. For example, the controller 122 may determine the frequency by sampling the input voltage signal and measuring the time between zero crossings, maximum values, or other points consistently measured during the input voltage signal cycles.

Figure 10:
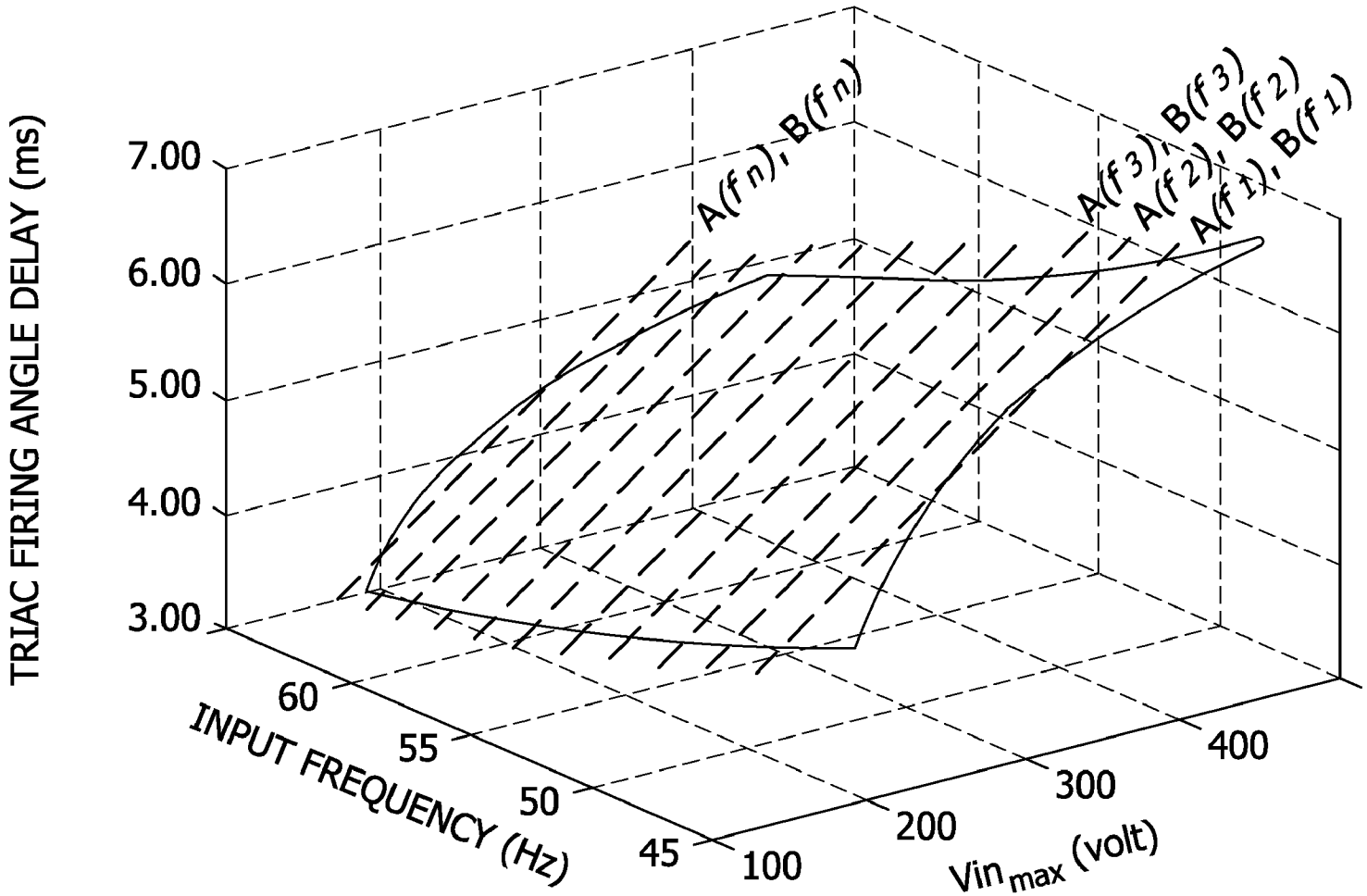
FIG. 10 is a three dimensional graph illustrating the relationship between maximum voltage of an input signal, frequency of an input signal, and delay angle.

The controller 122 may also include a storage memory for storing data associated with a plurality of frequencies. In particular, the storage memory may store sets of constants (A, B, C) each corresponding to one of the frequencies. The set of constants may be used in a linear formula in order to estimate the delay angle for the corresponding frequency. Accordingly, the controller 122 is configured to retrieve the set of constants which correspond to the determined frequency and determine the delay angle using a linear formula and the retrieved set of constants. FIG. 10 is a three dimensional plot for determining a delay angle based on a maximum measured voltage value and a determined frequency. In one embodiment, the illustrated plot may be implemented by the controller 122 using the stored sets of constants.

Figure 11:
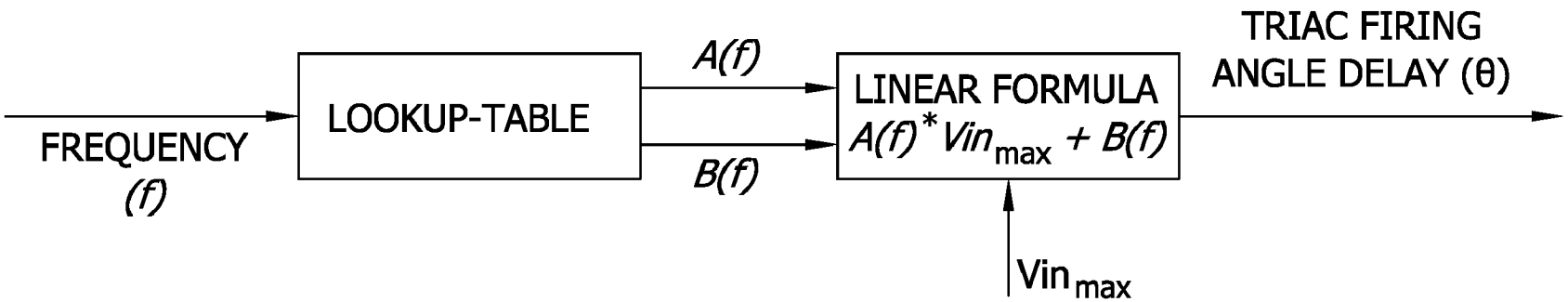
FIG. 11 is flow diagram illustrating a method implemented by a control circuit in a lamp system having a variable voltage and variable frequency power source according to an embodiment of the invention.

FIG. 11 illustrates a flow diagram for a method implemented by the controller 122 in a lamp system 100 having a variable frequency voltage input signal. The controller 122 determines the frequency of the input voltage input signal and queries a look up table for a set of constants corresponding to the determined frequency. The controller 122 retrieves a set of constants from the look up table. The controller 122 also receives the maximum measured voltage value from the input signal. The controller 122 computes the delay angle using the retrieved set of constants and the received maximum voltage in Equation 4 discussed above to compute the delay angle. The controller 122 is then configured to transmit a control signal to the AC chopper circuit to fire the delay angle at about from the zero crossing of the positive half cycle and at about T/2 (where T is the period for the cycle) for negative half cycle from the triac firing location for the positive half.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

APPENDIX A $$(v_o)_{rms} = \sqrt{\frac{1}{T}\int_0^T v_o^2(t)dt}$$

$$(v_o)_{rms} = \sqrt{\frac{1}{2\pi}\left(\int_\theta^\pi V_m^2\sin^2\beta\, d\beta + \int_\alpha^{2\pi} V_m^2\sin^2\beta\, d\beta\right)}$$

$$(v_o)_{rms} = \frac{V_m}{\sqrt{2\pi}}\sqrt{\int_\theta^\pi \sin^2\beta\, d\beta + \int_\alpha^{2\pi}\sin^2\beta\, d\beta}$$

$$(v_o)_{rms} = \frac{V_m}{2\sqrt{\pi}}\sqrt{\int_\theta^\pi (1-\cos 2\beta)\, d\beta + \int_\alpha^{2\pi}(1-\cos 2\beta)\, d\beta}$$

$$(v_o)_{rms} = \frac{V_m}{2\sqrt{\pi}}\sqrt{\left(\beta - \frac{\sin 2\beta}{2}\right)_\theta^\pi + \left(\beta - \frac{\sin 2\beta}{2}\right)_\alpha^{2\pi}}$$

$$(v_o)_{rms} = \frac{V_m}{2\sqrt{\pi}}\sqrt{\pi - \frac{\sin 2\pi}{2} - \theta + \frac{\sin 2\theta}{2} + 2\pi - \frac{\sin 4\pi}{2} - \alpha + \frac{\sin 2\alpha}{2}}$$

$$(v_o)_{rms} = \frac{V_m}{2\sqrt{\pi}}\sqrt{\pi - \frac{\sin 2\pi}{2} - \theta + \frac{\sin 2\theta}{2} + 2\pi - \frac{\sin 4\pi}{2} - \pi - \theta + \frac{\sin(2\pi + 2\theta)}{2}}$$

$$(v_o)_{rms} = \frac{V_m}{2\sqrt{\pi}}\sqrt{\pi - \frac{\sin 2\pi}{2} - \theta + \frac{\sin 2\theta}{2} + 2\pi - \frac{\sin 4\pi}{2} - \pi - \theta + \frac{\sin(2\pi + 2\theta)}{2}}$$

-continued $$(v_o)_{rms} = \frac{V_m}{2\sqrt{\pi}}\sqrt{2\pi - 2\theta + \sin 2\theta}$$

$$(v_o)_{rms} = \frac{V_m}{\sqrt{2\pi}}\sqrt{\pi - \theta + \sin\theta\cos\theta}$$

$$(v_o)_{rms} = \frac{(V_{in})_{rms}}{\sqrt{\pi}}\sqrt{\pi - \theta + \sin\theta\cos\theta}$$

What is claimed is:

1. A control circuit for a lamp in a lamp system wherein said lamp system is used in conjunction with an alternating current (AC) variable voltage power source to energize the lamp, said control circuit comprising:

a voltage sensing component for sensing the voltage of an voltage input signal as a function of time, said voltage input signal provided by the power source for energizing the lamp;

a controller configured to estimate a delay angle for the voltage input signal as a linear function of the sensed voltage; and an AC converter for modifying the voltage input signal according to the estimated delay angle to generate an AC voltage output signal having a constant root mean square voltage for energizing the lamp.

2. The control circuit of claim 1 wherein the voltage sensing component includes a first resistor and a second resistor for electrically connecting to the power source for sensing a stepped-down voltage of the voltage input signal as a function of time.

3. The control circuit of claim 1 wherein the lamp is an auxiliary lamp in the lamp system.

4. The control circuit of claim 1 wherein the lamp is an incandescent lamp in the Lamp system.

5. The control circuit of claim 1 wherein the AC converter includes a triac for selectively operating between in a conductive operating mode or a non-conductive operating mode as a function of the calculated first and second delay angles, wherein said triac conducts the voltage input signal in the conductive operating mode and said triac does not conduct the voltage input signal in the non-conductive operating mode.

6. A method for controlling a lamp of a lamp system wherein said lamp system receives a variable voltage input signal for energizing the lamp from an alternating current (AC) voltage power source, said method comprising:

detecting a voltage value of the input voltage signal at selected time intervals, said voltage input signal having a cycle as a function of time, wherein the cycle includes a positive half cycle and a negative half cycle; and determining a delay angle for each positive and negative half cycle as a linear function of said detected voltage value, wherein the voltage input signal is modified according to the determined delay angle to provide an AC voltage output signal having a constant root mean square voltage for energizing the lamp.

7. The method of claim 6 wherein said detecting includes detecting a first voltage value and a second voltage value near a first zero crossing of a particular cycle of the voltage input signal and detecting a third voltage value and a fourth voltage value near a second zero crossing of the particular cycle of the voltage input signal, and wherein said determining includes determining a delay angle for the positive half cycle of the particular cycle based on the detected first and second voltage values and determining a delay angle for the negative half cycle of the particular cycle based on the detected third and fourth voltage values.

8. The method of claim 6 wherein said detecting includes detecting a maximum voltage value of a cycle of the voltage input signal, and wherein said determining includes determining a delay angle for the positive and negative half cycles of said cycle as a linear function of the detected maximum voltage value for the cycle.

9. The method of claim 6 wherein the lamp is an auxiliary lamp.

10. A control circuit for a lamp of a lamp system wherein said lamp system is used in conjunction with an alternating current (AC) variable voltage power source to energize the lamp, said control circuit comprising:

an input channel for receiving an AC voltage input signal from the AC voltage power source, said received input signal having a cycle as a function of timer wherein the cycle includes a positive half cycle and a negative half cycle;

a voltage sensing component for detecting a first voltage value and a second voltage value of the input signal during the positive half cycle of said input signal, wherein said first voltage value is detected within a predefined time period of a zero crossing in which the input signal is increasing as a function of time, and wherein said second voltage value is detected within a predefined time period of a zero crossing in which the input signal is decreasing as a function of time;

a controller configured to calculate a first delay angle as a linear function of the detected first voltage value and to calculate a second delay angle as a linear function of the detected second voltage value; and an AC converter for modifying the AC voltage input signal to generate an AC voltage output signal having a constant root mean square voltage for energizing the lamp, wherein said modifying includes modifying the positive half cycle of the input signal according to the calculated first delay angle and modifying the negative half cycle of the input signal according to the calculated second delay angle.

11. The control circuit of claim 10 wherein the lamp is an auxiliary lamp in the lamp system.

12. The control circuit of claim 9 wherein the AC converter includes a triac for selectively operating between in a conductive operating mode or a non-conductive operating mode as a function of the calculated first and second delay angles, wherein said triac conducts the voltage input signal in the conductive operating mode and said triac does not conduct the voltage input signal in the non-conductive operating mode.

13. A method for controlling a lamp of a lamp system wherein said lamp system receives an alternating current (AC) voltage input signal for energizing the lamp from an AC variable voltage power source, said input signal having a cycle as a function of time, said method comprising:

receiving a first voltage value of the input signal, said first voltage value being measured near a zero crossing of the input signal during a portion of the cycle in which the input signal is positive and increasing as function of time;

receiving a second voltage value of the input signals said second voltage value being measured near a zero crossing of the input signal during a portion of the cycle in which the input signal is positive and decreasing as a function of time;

determining a first delay angle as a linear function of the first voltage value, wherein said first delay angle is applied to the portion of the cycle in which the input signal is positive; and determining a second delay angle as a linear function of the second voltage value, wherein said second delay angle is applied to a portion of the cycle in which the input signal is negative;

wherein an output voltage signal having a constant root mean square voltage is provided to the lamp when the determined first and second delay angles are applied to the input signal.

14. The method of claim 13 further calculating a first voltage difference, wherein said first voltage difference is the difference between the first voltage value and a pre-defined threshold voltage value, and wherein said determining a first delay angle includes determining a first delay angle as a linear function of the calculated first voltage difference.

15. The method of claim 13 further comprising calculating a second voltage difference, wherein said second voltage difference is the difference between the first voltage value and the second voltage value, and wherein said determining a second delay angle includes determining a second delay angle as a linear function of the calculated second voltage difference.

16. The method of claim 13 further comprising identifying a frequency of the input signal and wherein said determining a first delay angle includes determining a first delay angle as a linear function of the first voltage value and said identified frequency and wherein said determining a second delay angle includes determining a second delay angle as a linear function of the second voltage value and said identified frequency.

17. The method of claim 13 wherein the lamp is an auxiliary lamp.

18. A control circuit for a lamp of a lamp system wherein said lamp system is used in conjunction with an alternating current (AC) variable voltage power source to energize the lamp;

a voltage sensing component for measuring a maximum voltage value for each AC cycle of a voltage input signal provided by the power source for energizing the auxiliary lamp;

a controller configured to calculate a delay angle as a linear function of the measured maximum voltage; and an AC converter for modifying the voltage input signal according to the calculated delay angle to generate an output voltage signal having a constant root mean square voltage for energizing the lamp.

19. The control circuit of claim 18 wherein the lamp is an auxiliary lamp in the lamp system.

20. The control circuit of claim 18 wherein the AC converter includes a triac for selectively operating between in a conductive operating mode or a non-conductive operating mode as a function of the calculated first and second delay angles, wherein said triac conducts the voltage input signal in the conductive operating mode and said triac does not conduct the voltage input signal in the non-conductive operating mode.

21. A method for controlling a lamp of a lamp system wherein said lamp system receives a variable voltage input signal for energizing the lamp from an alternating current (AC) power source, said input signal having a cycle as a function of time, said method comprising: receiving a maximum measured voltage value of the voltage input signal for each cycle, said cycle including a positive half cycle and a negative half cycle: and determining a delay angle for each positive and negative half cycle as a linear function of the received maximum measured voltage value for the cycle; wherein an output voltage signal having a constant root mean square voltage is provided to the lamp when the determined delay angle is applied to the input signal.

22. The method of claim 21 wherein said receiving a maximum measured voltage value includes receiving a plurality of voltage values measured from the input signal at pre-determined time intervals, wherein said maximum measured voltage value is the largest received voltage value of the plurality.

23. The method of claim 21 further comprising identifying a frequency of the input signal and wherein said determining a delay angle for each positive and negative half cycle includes determining a delay angle for each positive and negative half cycle as a linear function of the received maximum measured voltage value for the cycle and said identified frequency.

24. The method of claim 21 wherein determining a delay angle includes determining a first delay angle for each positive cycle as a linear function of the received maximum measured voltage value for the cycle and determining a second delay angle for each negative cycle, wherein said second delay angle is the sum of the first delay angle and a time period corresponding to half of the cycle.

25. The method of claim 21 wherein the lamp is an auxiliary lamp.

* * * * *